US010991331B2

(12) United States Patent
Ji

(10) Patent No.: US 10,991,331 B2
(45) Date of Patent: Apr. 27, 2021

(54) DRIVING CIRCUIT AND DRIVING METHOD FOR DISPLAY PANEL AND DISPLAY DEVICE

(71) Applicant: HKC CORPORATION LIMITED, Guangdong (CN)

(72) Inventor: Feilin Ji, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 30 days.

(21) Appl. No.: 16/314,645

(22) PCT Filed: Dec. 6, 2018

(86) PCT No.: PCT/CN2018/119564
§ 371 (c)(1),
(2) Date: Dec. 31, 2018

(87) PCT Pub. No.: WO2020/087661
PCT Pub. Date: May 7, 2020

(65) Prior Publication Data

US 2020/0135130 A1 Apr. 30, 2020

(30) Foreign Application Priority Data

Oct. 31, 2018 (CN) ..... 201811286621.5

(51) Int. Cl.
*G09G 3/36* (2006.01)
*G09G 3/3266* (2016.01)

(52) U.S. Cl.
CPC ..... *G09G 3/3677* (2013.01); *G09G 3/3266* (2013.01); *G09G 2310/0264* (2013.01); *G09G 2330/021* (2013.01)

(58) Field of Classification Search
CPC ..... G09G 3/3266; G09G 2310/0267; G09G 3/3674; G09G 3/3677
See application file for complete search history.

(56) References Cited

U.S. PATENT DOCUMENTS

2009/0276668 A1* 11/2009 Hung ..... G01R 31/318555 714/726
2018/0190181 A1* 7/2018 Zhao ..... G09G 3/20
2019/0189052 A1* 6/2019 Moon ..... H01L 51/5203

* cited by examiner

*Primary Examiner* — Kent W Chang
*Assistant Examiner* — Scott D Au

(57) ABSTRACT

The present disclosure provides a driving circuit and driving method for a display panel and a display device, an output scanning signal is controlled through a scanning signal control circuit, such that a first-array-substrate-row driving circuit on a first lateral side of the display panel outputs a scanning signal according to a first enabling control signal, and a second-array-substrate-row driving circuit on a second lateral side of the display panel outputs a scanning signal according to a second enabling control signal, and driving of one side or two sides of the display panel is implemented.

16 Claims, 2 Drawing Sheets

DRIVING CIRCUIT AND DRIVING METHOD FOR DISPLAY PANEL AND DISPLAY DEVICE

CROSS-REFERENCE TO RELATED DISCLOSURE

This application is the PCT application No. PCT/CN2018/119564 for entry into US national phase with an international filing date of Dec. 6, 2018 designating US, and claims priority to Chinese Patent application No. 201811286621.5, filed with China National Intellectual Property Administration on Oct. 31, 2018, and titled "driving circuit and driving method for display panel and display device", the content of which is incorporated herein by reference in entirety.

TECHNICAL FIELD

The present disclosure pertains to the technical field of display device, and more particularly to a driving circuit for display panel, a driving method for display panel and a display device.

BACKGROUND

The statements herein provide background information related to the present disclosure without necessarily constituting an exemplary technique. With the continuous development of display technology, display equipment such as a liquid crystal panel, a display device and the like is continuously developed towards the direction of thinning, large screen, low power consumption and low cost. The liquid crystal panel includes rows and columns of pixel cells, when the liquid crystal panel works, a gate driving signal controls TFTs (Thin Film Transistors) in the pixel cells to be turned on or off so as to complete a row scanning of the liquid crystal panel, thereby achieving an image display function of the liquid crystal panel. An array substrate row driving technique is the technique of producing a gate line row scanning driving signal circuit on the array substrate to realize a driving mode of scanning gate lines line-by-line, the array substrate row of driving technique may reduce the cost remarkably, and is widely used in the display device.

However, electrostatic discharge or other process factors in the production process may generally cause a problem of disabling an exemplary GOA (Gate on Array) circuit, and the yield of the display panel is greatly reduced.

SUMMARY

An object of the present disclosure is to provide a driving circuit for a display panel which implements technical advantages including but are not limited to that the display panel may perform driving of one side or two sides thereof according to user requirement, a problem that driving of one side of the display panel malfunctions, so that the display panel cannot be used due to electrostatic discharge or other process factors in the production process of the display panel is avoided, and the yield of the display panel is improved.

An embodiment of the present disclosure provides a driving method for a display panel, where a first lateral side of the display panel is provided with a first scanning signal end, a second lateral side of the display panel is provided with a second scanning signal end, and the driving circuit comprises:

a scanning-signal-control circuit configured to output a first enabling control signal, a second enabling control signal and a scanning signal according to a control instruction as input by a user, wherein the control instruction comprises a first control instruction and a second control instruction;

a first-array-substrate-row driving circuit configured to output a scanning signal to the first scanning signal end according to the first enabling signal and the scanning signal; and a second-array-substrate-row driving circuit configured to output a scanning signal to the second scanning signal end according to the second enabling control signal and the scanning signal.

Optionally, the scanning-signal-control circuit includes:

a screen driving board configured to receive a video signal and output a start control logic signal, a scanning clock logic signal, a low frequency logic signal and an enabling control logic signal according to the video signal;

a level conversion circuit configured to receive the start control logic signal, the scanning clock logic signal, the low frequency logic signal and the enabling control logic signal, and to output an enabling control signal according to the enabling control logic signal, to output a first low frequency clock signal and a second low frequency clock signal according to the low frequency logic signal, and to output the scanning signal according to the scanning clock logic signal; where the scanning signal includes N-level scanning signals, N is greater than or equal to 1, and N is a positive integer;

a power management circuit configured to provide power supply to the screen driving board and the level conversion circuit respectively, where the power management circuit is respectively connected with the screen driving board and the level conversion circuit;

a first pull-up circuit configured to receive the enabling control signal and output a first enabling control signal according to the first control instruction and the enabling control signal; where an input of the first pull-up circuit is connected with an enabling control signal output of the level conversion circuit, and an output of the first pull-up circuit is connected with a first enabling control signal input of the display panel; and a second pull-up circuit configured to receive the enabling control signal and output a second enabling control signal according to the second control instruction and the enabling control signal; where an input of the second pull-up circuit is connected with an enabling control signal output of the level conversion circuit, and an output of the second pull-up circuit is connected with a second enabling control signal input of the display panel.

Optionally, the first pull-up circuit is a first switch, and the first switch is configured to be turned on or off according to the first control instruction;

a first end of the first switch serves as the input of the first pull-up circuit, and a second end of the first switch serves as the output of the first pull-up circuit.

Optionally, the first switch is an electronic switching transistor, a control end of the electronic switching transistor serves as the first end of the first switch, and a current output of the electronic switching transistor serves as the second end of the first switching transistor.

Optionally, the electronic switching transistor is an N-type thin film crystal field effect transistor;

a drain electrode of the N-type thin film crystal field-effect transistor is an input of the electronic switching transistor, a source electrode of the N-type thin-film crystal field effect transistor is an output of the electronic switching transistor, and a grid electrode of the N-type thin-film crystal field effect transistor is a control end of the electronic switching transistor.

Optionally, the electronic switching transistor is any one of a group consisting of a polycrystalline silicon thin film transistor, an amorphous silicon thin film transistor, a zinc oxide-based thin film transistor and an organic thin film transistor.

Optionally, the second pull-up circuit is a second switch, and the second switch is configured to be turned on or off according to the second control instruction;

a first end of the second switch serves as an input of the second pull-up circuit, and a second end of the second switch serves as an output of the second pull-up circuit.

Optionally, the second switch is an electronic switching transistor, a control end of the electronic switching transistor serves as the first end of the second switch, and a current output of the electronic switching transistor serves as the second end of the second switching transistor.

Optionally, the electronic switching transistor is an N-type thin film crystal field effect transistor;

a drain electrode of the N-type thin film crystal field-effect transistor is an input of the electronic switching transistor, a source electrode of the N-type thin-film crystal field effect transistor is an output of the electronic switching transistor, and a grid electrode of the N-type thin-film crystal field effect transistor is a control end of the electronic switching transistor.

Optionally, the electronic switching transistor is any one of a group consisting of a polycrystalline silicon thin film transistor, an amorphous silicon thin film transistor, a zinc oxide-based thin film transistor and an organic thin film transistor.

Optionally, the first switch is turned on when the first control instruction is a high level signal, the first switch is turned off when the first control instruction is a low level signal.

Optionally, the display panel comprises N rows of pixels and N scanning lines, a first end of each of the N scanning lines is connected with the first scanning signal end, and a second end of each of the N scanning lines is connected with the second scanning signal end; where each row of the pixels are connected with the corresponding scanning line, N is greater than or equal to 1, and N is a positive integer;

the N scanning lines are configured to receive the N-level scanning signals, where the X-level scanning signal is configured to drive the X-th row of pixels on the display panel, N is greater than or equal to X, X is greater than or equal to 1, and X is a positive integer.

Another embodiment of the present disclosure further provides a driving method of a display panel, where a first lateral side of the display panel is provided with a first scanning signal end, and a second lateral side of the display panel is provided with a second scanning signal end, and the driving method comprises:

outputting a first enabling control signal, a second enabling control signal and a scanning signal according to a control instruction as input by a user, wherein the control instruction comprises a first control instruction and a second control instruction;

outputting a scanning signal to the first scanning signal end according to the first enabling signal and the scanning signal; and outputting a scanning signal to the second scanning signal end according to the second enabling control signal and the scanning signal.

Optionally, the first control instruction is configured to control the first scanning signal end and the second scanning signal end to output a scanning signal respectively.

Optionally, the second control instruction is configured to control the first scanning signal end and the second scanning signal end to stop outputting the scanning signal.

Another embodiment of the present disclosure further provides a display device, including:

a display panel, a first lateral side of the display panel is provided with a first scanning signal end, and a second lateral side of the display panel is provided with a second scanning signal end; and a control circuit, where the control circuit includes:

a scanning-signal-control circuit configured to output a first enabling control signal, a second enabling control signal and a scanning signal according to a control instruction as input by a user, where the control instruction comprises a first control instruction and a second control instruction;

a first-array-substrate-row driving circuit configured to output a scanning signal to the first scanning signal end according to the first enabling signal and the scanning signal; and a second-array-substrate-row driving circuit configured to output a scanning signal to the second scanning signal end according to the second enabling control signal and the scanning signal.

Optionally, the scanning-signal-control circuit includes:

a screen driving board configured to receive a video signal and output a start control logic signal, a scanning clock logic signal, a low frequency logic signal and an enabling control logic signal according to the video signal;

a level conversion circuit configured to receive the start control logic signal, the scanning clock logic signal, the low frequency logic signal and the enabling control logic signal, and to output an enabling control signal according to the enabling control logic signal, to output a first low frequency clock signal and a second low frequency clock signal according to the low frequency logic signal, and to output a scanning signal according to the scanning clock logic signal; where the scanning signal comprise N-level scanning signals, N is greater than or equal to 1, and N is a positive integer;

a power management circuit configured to provide power supply to the screen driving board and the level conversion circuit respectively, where the power management circuit is respectively connected with the screen driving board and the level conversion circuit;

a first pull-up circuit configured to receive the enabling control signal and output a first enabling control signal according to the first control instruction and the enabling control signal; where an input of the first pull-up circuit is connected with an enabling control signal output of the level conversion circuit, and an output of the first pull-up circuit is connected with a first enabling control signal input of the display panel; and a second pull-up circuit configured to receive the enabling control signal and output a second enabling control signal according to the second control instruction and the enabling control signal; where an input of the second pull-up circuit is connected with an enabling control signal output of the level conversion circuit, and an output of the second pull-up circuit is connected with a second enabling control signal input of the display panel.

Optionally, the first pull-up circuit is a first switch, and the first switch is configured to be turned on or off according to the first control instruction;

a first end of the first switch serves as the input of the first pull-up circuit, and a second end of the first switch serves as the output of the first pull-up circuit.

Optionally, the first switch is an electronic switching transistor, a control end of the electronic switching transistor serves as the first end of the first switch, and a current output of the electronic switching transistor serves as the second end of the first switching transistor.

Optionally, the second pull-up circuit is a second switch and the second switch is configured to be turned on or off according to the second control instruction;

a first end of the second switch serves as an input of the second pull-up circuit, and a second end of the second switch serves as an output of the second pull-up circuit.

In the embodiments of the present disclosure, the output scanning signal is controlled by the scanning-signal-control circuit, such that the first-array-substrate-row driving circuit at the first lateral side of the display panel outputs a scanning signal according to the first enabling control signal, and the second-array-substrate-row driving circuit at the second lateral side of the display panel outputs a scanning signal according to the second enabling control signal, which enables the display panel to perform driving of one side or two sides thereof according to user requirement, and a problem that driving of one side of the display panel malfunctions, so that the driving panel cannot be used due to electrostatic discharge or other processing factors in the production process of the display panel is avoided, and the yield of the display panel is improved.

BRIEF DESCRIPTION OF THE DRAWINGS

In order to explain this embodiments of the present disclosure more clearly, a brief introduction regarding the accompanying drawings that need to be used for describing this embodiments is given below; it is obvious that the accompanying drawings described as follows are only some embodiments of the present disclosure, for ordinarily skilled one in the art, other drawings may also be obtained according to the current drawings on the premise of paying no creative labor.

DESCRIPTION OF THIS EMBODIMENTS

In order to make the purpose, the technical solution and the advantages of the present disclosure be clearer and more understandable, the present disclosure is further described in detail below with reference to accompanying figures and embodiments. It should be understood that the specific embodiments described herein are merely intended to illustrate but not to limit the present disclosure.

It should be noted that, when one component is described to be "fixed to" or "arranged on" another component, this component may be directly or indirectly arranged on another component. When one component is described to be "connected with" another component, it may be directly or indirectly connected to the other component. Orientation or position relationships indicated by terms including "upper", "lower", "left" and "right" are based on the orientation or position relationships shown in the accompanying figures and is only used for the convenience of description, instead of indicating or implying that the indicated device or element must have a specific orientation and is constructed and operated in a particular orientation, and thus should not be interpreted as limitation to the present disclosure. For the person of ordinary skill in the art, the specific meanings of the aforesaid terms may be interpreted according to specific conditions. Terms of "the first" and "the second" are only for the purpose of describing conveniently and should not be interpreted as indicating or implying relative importance or impliedly indicating the number of indicated technical features. "Multiple/a plurality of means two or more unless there is an additional explicit and specific limitation.

In order to explain the technical solution of the present disclosure, a detailed description will be given below with reference to the specific accompanying figures and the embodiments.

One embodiment of the present disclosure provides a driving circuit for a display panel, a first lateral side of the display panel is provided with a first scanning signal end, and a second lateral side of the display panel is provided with a second scanning signal end.

In one or more embodiments, the first lateral side of the display panel is a left side of the display panel, and the second lateral side of the display panel is a right side of the display panel. Where the display panel includes a plurality of pixels, and the plurality of pixels are arranged in array, the X-th row of pixels are connected with the X-th row of scanning lines, and the Y-th column of pixels are connected with the Y-th column of data lines, where X is greater than or equal to 1 and X is a positive integer; Y is greater than or equal to 1 and Y is a positive integer. The first lateral side of the display panel is a first end of the scanning line, and the second lateral side of the display panel is a second end of the scanning line.

Figure 1:
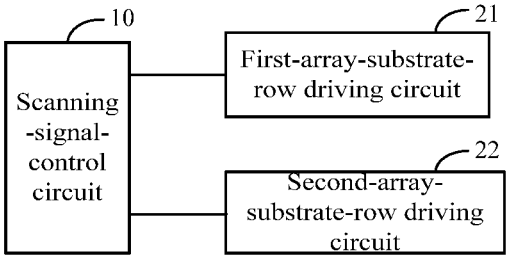
FIG. 1 illustrates a schematic structural diagram of a driving circuit for a display panel provided by one embodiment of the present disclosure.

FIG. 1 illustrates a schematic structural diagram of a driving circuit for a display panel according to an embodiment of the present disclosure.

As shown in FIG. 1, the driving circuit includes:

a scanning-signal-control circuit 10 configured to output a first enabling control signal, a second enabling control signal and a scanning signal according to a control instruction as input by a user, where the control instruction includes a first control instruction and a second control instruction;

a first-array-substrate-row driving circuit 21 configured to output a scanning signal to the first scanning signal end according to the first enabling control signal and the scanning signal;

a second-array-substrate-row driving circuit 22 configured to output a scanning signal to the second scanning signal end according to the second enabling control signal and the scanning signal.

In one or more embodiments, the first-array-substrate-row driving circuit 21 is arranged on the first lateral side of the display panel, and a scanning signal output of the first-array-substrate-row driving circuit 21 is connected with a first scanning signal end on the first lateral side of the display panel; where the scanning signal output of the first-array-substrate-row driving circuit 21 includes N scanning signal outputs, the display panel includes N scanning lines, and the first scanning signal end of the N scanning lines on the first lateral side of the display panel includes N scanning line inputs, and the N scanning signal outputs of the first-array-substrate-row driving circuit 21 are respectively connected with the N scanning lines of the display panel through the N scanning line inputs on the first lateral side of the display panel; where N is greater than or equal to X, and X is greater than or equal to 1, and N is a positive integer.

In one or more embodiments, the second-array-substrate-row driving circuit 22 is arranged on the second lateral side of the display panel, and the scanning signal output of the second-array-substrate-row driving circuit 22 is connected with the second scanning signal end on the second lateral side of the display panel; where the second-array-substrate-row driving circuit 22 includes N scanning signal outputs, the display panel includes N scanning lines, the second scanning signal end of the N scanning lines on the second lateral side of the display panel includes N scanning line inputs, and the N scanning signal outputs of the second-array-substrate-row driving circuit 22 are respectively connected with the N scanning lines of the display panel through the N scanning line inputs on the second lateral side of the display panel, N is greater than or equal to X and X is greater than or equal to 1, and N is a positive integer.

In one or more embodiments, the scanning-signal-control circuit 10 may output the first enabling control signal and the second enabling control signal simultaneously according to the control instruction as input by the user, at this moment, GOA (Gate On Array) circuits on the first lateral side and the second lateral side of the display panel are configured to output a scanning signal simultaneously; particularly, the first-array-substrate-row driving circuit 21 is configured to output a scanning signal to the first scanning signal end on the first lateral side of the display panel according to the first enabling control signal and the scanning signal, the second-array-substrate-row driving circuit 22 is configured to output a scanning signal to the second scanning signal end on the second lateral side of the display panel according to the second enabling control signal and the scanning signal, driving of two sides of the display panel is realized, and a problem that driving of one side of the display panel malfunctions, so that the display panel cannot be used due to static electricity release or other process factors in the production process of the display panel is avoided.

Figure 2:
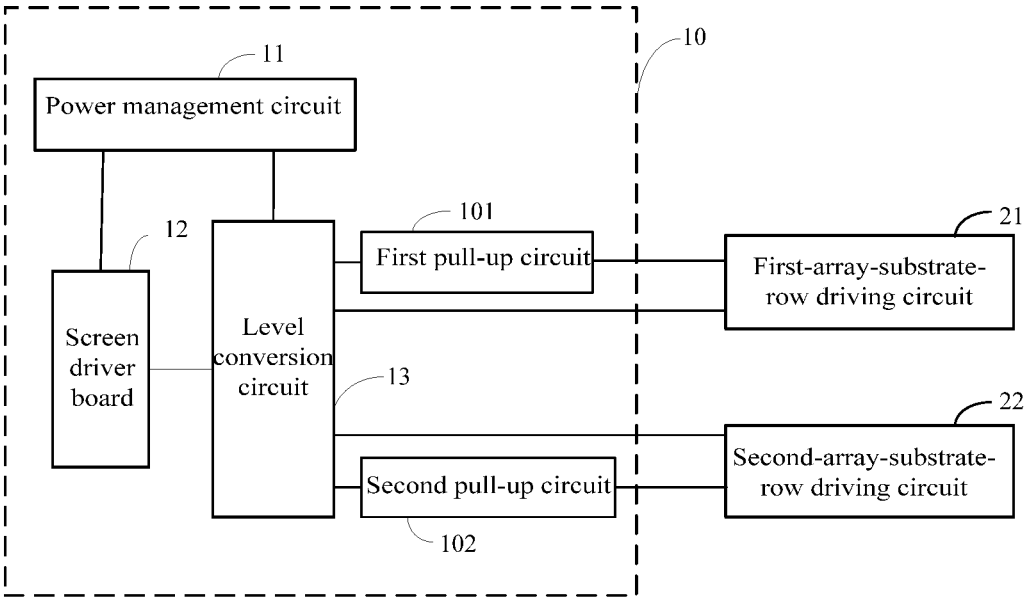
FIG. 2 illustrates a schematic structural diagram of a driving circuit for a display panel provided by another embodiment of the present disclosure.

FIG. 2 illustrates a schematic structural diagram of a driving circuit for a display panel according to another embodiment of the present disclosure.

As shown in FIG. 2, the scanning-signal-control circuit 10 includes:

a screen driving board 12, the screen driving board 12 is configured to receive a video signal and output a start control logic signal, a scanning clock logic signal, a low frequency logic signal and an enabling control logic signal according to the video signal;

a level conversion circuit 13, the level conversion circuit 13 is configured to receive the start control logic signal, the scanning clock logic signal, the low frequency logic signal and the enabling control logic signal, and to output an enabling control signal according to the enabling control logic signal, to output a first low frequency clock signal and a second low frequency clock signal according to the low frequency logic signal, and to output a scanning signal according to the scanning clock logic signal; where N is greater than or equal to 1, and N is a positive integer;

a power management circuit 11 configured to provide power supply to the screen driving board 12 and the level conversion circuit 13 respectively, and the power management circuit 11 is connected with the screen driving board 12 and the level conversion circuit 13 respectively;

a first pull-up circuit 101, the first pull-up circuit 101 is configured to receive the enabling control signal and output a first enabling control signal according to the first control instruction and the enabling control signal; where an input of the first pull-up circuit 101 is connected with an enabling control signal output of the level conversion circuit 13, and an output of the first pull-up circuit 101 is connected with a first enabling control signal input of the display panel;

a second pull-up circuit 102, the second pull-up circuit 102 is configured to receive an enabling control signal and output a second enabling control signal according to the second control instruction and the enabling control signal, where an input of the second pull-up circuit 102 is connected with an enabling control signal output of the level conversion circuit 13, and an output of the second pull-up circuit 102 is connected with a second enabling control signal input of the display panel.

In one or more embodiments, the screen driving board 12 analyzes the video signal after receiving the video signal, at this moment, the screen driving board is additionally provided with a GIPO (General Purpose Input and Output) which is configured to output an enabling control logic signal T_EN to the level conversion circuit 13; the level conversion circuit 13 is additionally provided with a low frequency signal port which is configured to convert the enabling control logic signal into an enabling control signal EN, and said enabling control signal includes a high level signal VGH and a low level signal VGL.

In one or more embodiments, the first pull-up circuit 101 is a first switch, and the first switch may be turned on or off according to the first control instruction.

Particularly, a first end of the first switch serves as the input of the first pull-up circuit 101, and a second end of the first switch serves as the output of the first pull-up circuit 101.

In one or more embodiments, the first control instruction may be set according to user requirement; for example, the first control instruction may be the instruction of turning off the first switch, at this moment, the first switch is turned on and the first-array-substrate-row driving circuit 21 may receive the first enabling control signal; when the first enabling control signal is a high level signal, the first-array-substrate-row driving circuit 21 outputs a scanning signal, when the first enabling control signal is a low level signal, at this time, the first-array-substrate-row driving circuit 21 stops outputting the scanning signal.

In one or more embodiments, the first control instruction may be the instruction of turning on the first switch, at this moment, the first-array-substrate-row driving circuit 21 cannot receive the first enabling control signal, therefore, the first-array-substrate-row driving circuit 21 does not output the scanning signal.

In one or more embodiments, turning off the first switch may be implemented by welding a resistance between the enabling control signal input of the first-array-substrate-row driving circuit 21 and the enabling control signal output of the level conversion circuit 13, such that the first-array-substrate-row driving circuit 21 may receive the enabling control signal as output by the level conversion circuit 13.

In one or more embodiments, turning on the first switch may disconnect the resistance welded between the enabling control signal input of the first-array-substrate-row driving circuit 21 and the enabling control signal output of the level conversion circuit 13, such that the first-array-substrate-row driving circuit 21 cannot receive the enabling control signal as output by the level conversion circuit 13, and the first-array-substrate-row driving circuit 21 at the first lateral side of the display panel may not drive the display panel.

In one or more embodiments, the first switch is an electronic switching transistor, a control end of the electronic switching transistor serves as the first end of the first switch, a current output of the electronic switching transistor serves as the second end of the first switching transistor.

In one or more embodiments, the electronic switching transistor is an N-type thin film crystal field effect transistor;

a drain electrode of the N-type thin film crystal field effect transistor is an input of the electronic switching transistor, a source electrode of the N-type thin film crystal field effect transistor is an output of the electronic switching transistor, and a grid electrode of the N-type thin film crystal field effect transistor is a control end of the electronic switching transistor.

In one or more embodiments, the electronic switching transistor is any one of a group consisting of a polycrystalline silicon thin film transistor, an amorphous silicon thin film transistor, a zinc oxide-based thin film transistor and an organic thin film transistor.

In one or more embodiments, the second pull-up circuit 102 is a second switch, and the second switch may be turned on or off according to the second control instruction.

Particularly, a first end of the second switch serves as the input of the second pull-up circuit 102, and a second end of the second switch serves as the output of the second pull-up circuit 102.

In one or more embodiments, the second control instruction may be set according to user requirement; for example, the second control instruction may be the instruction of turning off the second switch; at this moment, the second switch is turned on, the second-array-substrate-row driving circuit 22 may receive the second enabling control signal; when the second enabling control signal is a high level signal, at this time, the second-array-substrate-row driving circuit 22 outputs the scanning signal; when the second enabling control signal is a low level signal, at this time, the second-array-substrate-row driving circuit 22 stops outputting the scanning signal.

In one or more embodiments, the second control instruction may be the instruction of turning on the second switch, at this moment, the second-array-substrate-row driving circuit 22 may not receive the second enabling control signal, therefore, the second-array-substrate-row driving circuit 22 does not output the scanning signal.

In one or more embodiments, turning off the second switch may be implemented by welding a resistance between the enabling control signal input of the second-array-substrate-row driving circuit 22 and the enabling control signal output of the level conversion circuit 13, such that the second-array-substrate-row driving circuit 22 may receive the enabling control signal as output by the level conversion circuit 13, and the second-array-substrate-row driving circuit 22 at the second lateral side of the display panel is enabled to drive the display panel.

In one or more embodiments, turning on the second switch may disconnect the resistance welded between the enabling control signal input of the second-array-substrate-row driving circuit 22 and the enabling control signal output of the level conversion circuit 13, such that the second-array-substrate-row driving circuit 22 may not receive the enabling control signal as output by the level conversion circuit 13.

In one or more embodiments, the first enabling control signal and the second enabling control signal may be output simultaneously according to the control instruction as input by the user, that is, the user outputs the first control instruction of controlling the first switch to be turned off and outputs the second control instruction of controlling the second switch to be turned off simultaneously, at this time, the GOA circuits at the first lateral side and the second lateral side of the display panel output scanning signals at the same time; in particular, the first-array-substrate-row driving circuit 21 outputs a scanning signal to the first scanning signal end of the first lateral side of the display panel according to the first enabling control signal and the scanning signal, the second-array-substrate-row driving circuit 22 outputs a scanning signal to the second scanning signal end of the second lateral side of the display panel according to the second enabling control signal and the scanning signal, driving of two sides of the display panel is realized, and the problem that driving of one side of the display panel malfunctions so that the display panel cannot be used due to electrostatic discharge or other process factors in the production process of the display panel is avoided.

In one or more embodiments, the second switch is an electronic switching transistor, a control end of the electronic switching transistor serves as the first end of the second switch, and a current output of the electronic switching transistor serves as the second end of the second switching transistor.

In one or more embodiments, the electronic switching transistor is an N-type thin film crystal field effect transistor;

a drain electrode of the N-type thin film crystal field effect transistor is an input of the electronic switching transistor, a source electrode of the N-type thin film crystal field effect transistor is an output of the electronic switching transistor, and a grid electrode of the N-type thin film crystal field effect transistor is a control end of the electronic switching transistor.

In one or more embodiments, the electronic switching transistor is any one of a group consisting of a polycrystalline silicon thin film transistor, an amorphous silicon thin film transistor, a zinc oxide-based thin film transistor and an organic thin film transistor.

In one or more embodiments, the first switch is turned on when the first control instruction is a high level signal, the first switch is turned off when the first control instruction is a low level signal.

In one or more embodiments, the display panel includes N rows of pixels and N scanning lines, a first end of each of the N scanning lines is connected with the first scanning signal end, and a second end of each of the N scanning lines is connected with the second scanning signal end, where each row of the pixels are connected with a corresponding scanning line, N is greater than or equal to 1, and N is a positive integer.

Particularly, the N scanning lines are configured to receive N-level scanning signals, where the X-th scanning signal is configured to drive the X-th row of pixels on the display panel, X is greater than or equal to 1, and X is a positive integer.

In one or more embodiments, the first pull-up circuit 101 is an electronic switching transistor.

In one or more embodiments, the second pull-up circuit 102 is an electronic switching transistor.

Another embodiment of the present disclosure further provides a driving method for the display panel, a first lateral side of the display panel is provided with a first scanning signal end, and a second lateral side of the display panel is provided with a second scanning signal end.

In one or more embodiments, the display panel includes N rows of pixels and N scanning lines, the X-th row of pixels are connected with the X-th row of scanning lines, and the first scanning signal ends of the N scanning lines on the first lateral side of the display panel include N scanning line inputs, the first ends of the N scanning lines are connected with the first scanning signal end, the second scanning signal end of the N scanning lines on the second lateral side of the display panel includes N scanning line inputs, and the second ends of the N scanning lines are connected with the second scanning signal end. Where, N is greater than or equal to 1 and N is a positive integer.

Figure 3:
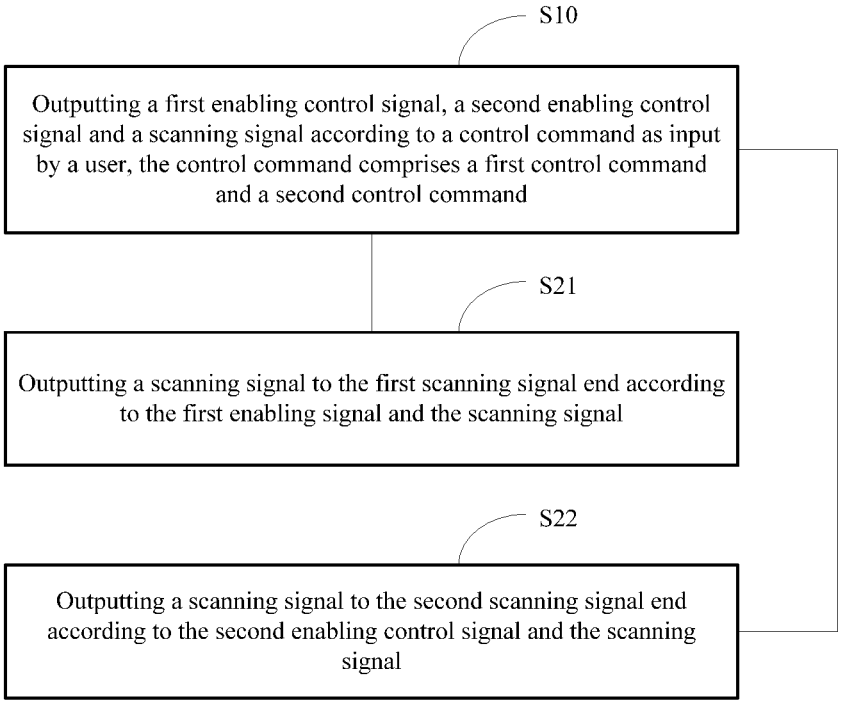
FIG. 3 illustrates a block flow diagram of a driving method for a display panel provided by one embodiment of the present disclosure.

FIG. 3 illustrates a block flow diagram of a driving method for display panel according to an embodiment of the present disclosure.

As shown in FIG. 3, the driving method in this embodiment includes:

step S10, outputting a first enabling control signal, a second enabling control signal and a scanning signal according to a control instruction as input by a user, where the control instruction includes a first control instruction and a second control instruction;

step S21, outputting a scanning signal to the first scanning signal end according to the first enable control signal and the scanning signal; and step S22, outputting a scanning signal to the second scanning signal end according to the second enabling control signal and the scanning signal.

In one or more embodiments, the first enabling control signal and the second enabling control signal may be output simultaneously according to the control instruction as input by the user, at this moment, the GOA circuits on the first lateral side and the second lateral side of the display panel output a scanning signal at the same time; particularly, the GOA circuit on the first lateral side of the display panel output a scanning signal to the first scanning signal end on the first lateral side of the display panel according to the first enabling control signal and the scanning signal, the GOA circuit on the second lateral side of the display panel outputs a scanning signal to the second scanning signal end of the second lateral side of the display panel according to the second enabling control signal and the scanning signal, driving of two sides of the display panel is realized, and the problem that driving of one side of the display panel malfunctions so that the display panel cannot be used due to static electricity release or other process factors in the production process of the display panel is avoided.

In one or more embodiments, the first control instruction is configured to control the first scanning signal end and the second scanning signal end to output a scanning signal.

In one or more embodiments, the second control instruction is configured to control the first the scanning signal end and the second scanning signal end to stop outputting a scanning signal.

Figure 4:
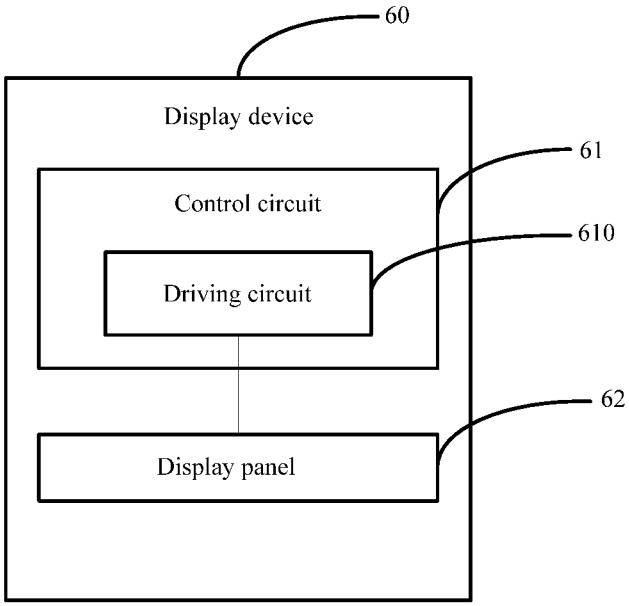
FIG. 4 illustrates a structural block diagram of a display device provided by one embodiment of the present disclosure.

Another embodiment of the present disclosure further provides a display device, FIG. 4 illustrates a structural block diagram of the display device provided by one embodiment of the present disclosure.

As shown in FIG. 4, in this embodiment, the display device 60 includes:

a display panel 62, where a first lateral side of the display panel 62 is provided with a first scanning signal end, and a second lateral side of the display panel 62 is provided with a second scanning signal end; and a control circuit 61, where the control circuit 61 includes:

a scanning-signal-control circuit 10, the scanning-signal-control circuit 10 is configured to output a first enabling control signal, a second enabling control signal and a scanning signal according to a control instruction as input by an user, where the control instruction includes a first control instruction and a second control instruction;

a first-array-substrate-row driving circuit 21, the first-array-substrate-row driving circuit 21 is configured to output a scanning signal to the first scanning signal end according to the first enabling control signal and the scanning signal; and a second-array-substrate-row driving circuit 22, the second-array-substrate-row driving circuit 22 is configured to output a scanning signal to the second scanning signal end according to the second enabling control signal and the scanning signal.

In one or more embodiments, the first-array-substrate-row driving circuit 21 is arranged on the first lateral side of the display panel, and a scanning signal output of the first-array-substrate-row driving circuit 21 is connected with a first scanning signal end on the first lateral side of the display panel; where the scanning signal output of the first-array-substrate-row driving circuit 21 includes N scanning signal outputs, the display panel includes N scanning lines, the first scanning signal end of the N scanning lines on the first lateral side of the display panel includes N scanning line inputs, and the N scanning signal outputs of the first-array-substrate-row driving circuit 21 are respectively connected with the N scanning lines of the display panel through the N scanning line inputs on the first lateral side of the display panel, N is greater than or equal to X and X is greater than or equal to 1, and N is a positive integer.

In one or more embodiments, the second-array-substrate-row driving circuit 22 is arranged on the second lateral side of the display panel, and the scanning signal output of the second-array-substrate-row driving circuit 22 is connected with the second scanning signal end on the second lateral side of the display panel; where the second-array-substrate-row driving circuit 22 includes N scanning signal outputs, the display panel includes N scanning lines, the second scanning signal end of the N scanning lines on the second lateral side of the display panel includes N scanning line inputs, and the N scanning signal outputs of the second-array-substrate-row driving circuit 22 are respectively connected with the N scanning lines of the display panel through the N scanning line inputs on the second lateral side of the display panel, N is greater than or equal to X and X is greater than or equal to 1, and N is a positive integer.

In one or more embodiments, the scanning-signal-control circuit 10 may output the first enabling control signal and the second enabling control signal simultaneously according to the control instruction as input by the user, at this moment, the GOA (Gate On Array) circuits on the first lateral side and the second lateral side of the display panel are configured to output a scanning signal simultaneously; particularly, the first-array-substrate-row driving circuit 21 is configured to output a scanning signal to the first scanning signal end on the first lateral side of the display panel according to the first enabling control signal and the scanning signal outputs a scanning signal, the second-array-substrate-row driving circuit 22 is configured to output a scanning signal to the second scanning signal end on the second lateral side of the display panel according to the second enabling control signal and the scanning signal, a driving of two sides of the display panel is realized, and a problem that driving of one side of the display panel malfunctions so that the display panel cannot be used due to static electricity release or other process factors in the production process of the display panel is avoided.

In one or more embodiments, the scanning-signal-control circuit 10 includes:

a screen driving board 12 configured to receive a video signal and output a start control logic signal, a scanning clock logic signal, a low frequency logic signal and an enabling control logic signal according to the video signal;

a level conversion circuit 13 configured to receive the start control logic signal, the scanning clock logic signal, the low frequency logic signal and the enabling control logic signal, and to output an enabling control signal according to the enabling control logic signal, to output a first low frequency clock signal and a second low frequency clock signal according to the low frequency logic signal, and to output a scanning signal according to the scanning clock logic signal; where N is greater than or equal to 1, and N is a positive integer;

a power management circuit 11 configured to provide power supply to the screen driving board 12 and the level conversion circuit 13 respectively, where the power management circuit 11 is connected with the screen driving board 12 and the level conversion circuit 13 respectively;

a first pull-up circuit 101 configured to receive the enabling control signal and output a first enabling control signal according to the first control instruction and the enabling control signal; where an input of the first pull-up circuit 101 is connected with an enabling control signal output of the level conversion circuit 13, and an output of the first pull-up circuit 101 is connected with a first enabling control signal input of the display panel;

a second pull-up circuit 102 configured to receive the enabling control signal and output a second enabling control signal according to the second control instruction and the enabling control signal, where an input of the second pull-up circuit 102 is connected with an enabling control signal output of the level conversion circuit 13, and an output of the second pull-up circuit 102 is connected with a second enabling control signal input of the display panel.

In one or more embodiments, the screen driving board 12 analyzes the video signal after receiving the video signal, at this moment, the screen driving board is additionally provided with a GIPO (General Purpose Input and Output) which is configured to output an enabling control logic signal T_EN to the level conversion circuit 13, the level conversion circuit 13 is additionally provided with a low frequency signal port configured to convert the enabling control logic signal into an enabling control signal EN, this enabling control signal includes a high level signal VGH and a low level signal VGL.

In one or more embodiments, the first pull-up circuit 101 is a first switch, and the first switch may be turned on or off according to the first control instruction.

Particularly, a first end of the first switch serves as the input of the first pull-up circuit 101, and a second end of the first switch serves as the output of the first pull-up circuit 101.

In one or more embodiments, the first control instruction may be set according to user requirement; for example, the first control instruction may be the instruction of turning off the first switch, at this moment, the first switch is turned on and the first-array-substrate-row driving circuit 21 may receive the first enabling control signal; when the first enabling control signal is a high level signal, at this time, the first-array-substrate-row driving circuit 21 outputs a scanning signal, when the first enabling control signal is a low level signal, at this time, the first-array-substrate-row driving circuit 21 stops outputting the scanning signal.

In one or more embodiments, the first control instruction may be the instruction of turning on the first switch, at this moment, the first-array-substrate-row driving circuit 21 may not receive the first enabling control signal, therefore, the first-array-substrate-row driving circuit 21 does not output the scanning signal.

In one or more embodiments, turning off the first switch may be implemented by welding a resistance between the enabling control signal input of the first-array-substrate-row driving circuit 21 and the enabling control signal output of the level conversion circuit 13, such that the first-array-substrate-row driving circuit 21 may receive the enabling control signal as output by the level conversion circuit 13.

In one or more embodiments, the first pull-up circuit 101 is a first switch, and the first switch may be turned on or off according to the first control instruction;

a first end of the first switch serves as the input of the first pull-up circuit 101, and a second end of the first switch serves as the output of the first pull-up circuit 101.

In one or more embodiments, the first switch is an electronic switching transistor, a control end of the electronic switching transistor serves as the first end of the first switch, and a current output of the electronic switching transistor serves as the second end of the first switching transistor.

In one or more embodiments, the second pull-up circuit 102 is a second switch, and the second switch may be turned on or off according to the second control instruction.

Particularly, a first end of the second switch serves as the input of the second pull-up circuit 102, and a second end of the second switch serves as the output of the second pull-up circuit 102.

In one or more embodiments, the second control instruction may be set according to user requirement; for example, the second control instruction may be the instruction of turning off the second switch; at this moment, the second switch is turned on, the second-array-substrate-row driving circuit 22 may receive the second enabling control signal, when the second enabling control signal is a high level signal, at this time, the second-array-substrate-row driving circuit 22 outputs the scanning signal; when the second enabling control signal is a low level signal, at this time, the second-array-substrate-row driving circuit 22 stops outputting the scanning signal.

In one or more embodiments, the second control instruction may be the instruction of turning on the second switch, at this moment, the second-array-substrate-row driving circuit 22 may not receive the second enabling control signal, therefore, the second-array-substrate-row driving circuit 22 does not output the scanning signal.

In one or more embodiments, turning off the second switch may be implemented by welding a resistance between the enabling control signal input of the second-array-substrate-row driving circuit 22 and the enabling control signal output of the level conversion circuit 13, such that the second-array-substrate-row driving circuit 22 may receive the enabling control signal as output by the level conversion circuit 13, and the second-array-substrate-row driving circuit 22 at the second lateral side of the display panel is enabled to drive the display panel.

In one or more embodiments, the second pull-up circuit 102 is a second switch, and the second switch may be turned on or off according to the second control instruction;

a first end of the second switch serves as the input of the second pull-up circuit 102, and a second end of the second switch serves as the output of the second pull-up circuit 102.

In one embodiment, the display device 60 may be any type of display device which is provided with the aforesaid driving circuit 610 such as LCD (Liquid Crystal Display), OLED (Organic Light Emitting Diode) display device, QLED (Quantum Dot Light Emitting Diode) display device, curved surface display device and so on.

In one or more embodiments, the display panel 62 includes a pixel array consisted of rows and columns of pixels.

In one or more embodiments, the control circuit 61 may be implemented by a universal integrated circuit such as CPU (Central Processing Unit) or ASIC (Application Specific Integrated Circuit).

In the embodiment of the present disclosure, the output scanning signal is controlled by the scanning-signal-control circuit, such that the first-array-substrate-row driving circuit at the first lateral side of the display panel output a scanning signal according to the first enabling control signal, and the second-array-substrate-row driving circuit at the second lateral side of the display panel output a scanning signal according to the second enabling control signal, which enables the display panel to perform driving of one side or two sides thereof according to user requirement, a problem that driving of one side of the display panel malfunctions, so that the driving panel cannot be used due to electrostatic discharge or other processing factors in the production process of the display panel is avoided, and a yield of the display panel is improved.

In one or more embodiments, the circuits in the aforesaid embodiments may be CPU (Central Processing Unit), and may also be other general purpose processor, DSP (Digital Signal Processor), ASIC (Application Specific Integrated Circuit), FGPA (Field-Programmable Gate Array), or some other programmable logic devices, discrete gate or transistor logic device, discrete hardware component, etc.

In one or more embodiments, the general purpose processor may be a microprocessor, or alternatively, the processor may also be any conventional processor, etc.

The foregoing is only optional embodiments of the present disclosure and are not intended to limit the present disclosure. For ordinarily skilled one in the art, there may be various modifications and variations in the present disclosure. Any modification, equivalent replacement, improvement, and the like, which are made within the spirit and the principle of the present disclosure, should all be included in the protection scopes of the claims of the present disclosure.

What is claimed is:

1. A driving circuit for a display panel, wherein a first lateral side of the display panel is provided with a first scanning signal end, a second lateral side of the display panel is provided with a second scanning signal end, and the driving circuit comprises:

a scanning-signal-control circuit configured to output a first enabling control signal, a second enabling control signal and a scanning signal according to a control instruction as input by a user, wherein the control instruction comprises a first control instruction and a second control instruction;

a first-array-substrate-row driving circuit configured to output the scanning signal to the first scanning signal end under control of the first enabling signal; and a second-array-substrate-row driving circuit configured to output the scanning signal to the second scanning signal end under control of the second enabling control signal;

wherein the scanning-signal-control circuit comprises:

a screen driving board configured to receive a video signal and output a start control logic signal, a scanning clock logic signal, a low frequency logic signal and an enabling control logic signal according to the video signal;

a level conversion circuit configured to receive the start control logic signal, the scanning clock logic signal, the low frequency logic signal and the enabling control logic signal, and to output an enabling control signal according to the enabling control logic signal, to output a first low frequency clock signal and a second low frequency clock signal according to the low frequency logic signal, and to output the scanning signal according to the scanning clock logic signal; wherein the scanning signal comprise N-level scanning signals, and wherein N is greater than or equal to 1, and N is a positive integer;

wherein the screen driving board is provided with a GIPO (General Purpose Input and Output) which is configured to output an enabling control logic signal to the level conversion circuit, the level conversion circuit is provided with a low frequency signal port configured to convert the enabling control logic signal into an enabling control signal, this enabling control signal includes a high level signal and a low level signal;

a power management circuit configured to provide power supply to the screen driving board and the level conversion circuit respectively, wherein the power management circuit is respectively connected with the screen driving board and the level conversion circuit;

a first pull-up circuit configured to receive the enabling control signal and output a first enabling control signal according to the first control instruction and the enabling control signal; wherein an input of the first pull-up circuit is connected with an enabling control signal output of the level conversion circuit, and an output of the first pull-up circuit is connected with a first enabling control signal input of the display panel; and a second pull-up circuit configured to receive the enabling control signal and output a second enabling control signal according to the second control instruction and the enabling control signal; wherein an input of the second pull-up circuit is connected with an enabling control signal output of the level conversion circuit, and an output of the second pull-up circuit is connected with a second enabling control signal input of the display panel.

2. The driving circuit of the display panel according to claim 1, wherein the first pull-up circuit is a first switch, and the first switch is configured to be turned on or off according to the first control instruction;

a first end of the first switch serves as the input of the first pull-up circuit, and a second end of the first switch serves as the output of the first pull-up circuit.

3. The driving circuit of the display panel according to claim 2, wherein the first switch is an electronic switching transistor, a control end of the electronic switching transistor serves as the first end of the first switch, and a current output of the electronic switching transistor serves as the second end of the first switching transistor.

4. The driving circuit of the display panel according to claim 2, wherein the first switch is turned n when the first control instruction is a high level signal, the first switch is turned off when the first control instruction is a low level signal.

5. The driving circuit for the display panel according to claim 2, wherein turning off the first switch is implemented by welding a resistance between an enabling control signal input of the first-array-substrate-row driving circuit and an enabling control signal output of the level conversion circuit.

6. The driving circuit for the display panel according to claim 2, wherein the first control instruction is an instruction of turning off the first switch, at this moment, the first switch is Mined on and the first-array-substrate-row driving circuit receives the first enabling control signal; when the first enabling control signal is a high level signal, the first-array-substrate-row driving circuit outputs a scanning signal, when the first enabling control signal is a low level signal, the first-array-substrate-row driving circuit stops outputting the scanning signal.

7. The driving circuit of the display panel according to claim 1, wherein the second pull-up circuit is a second switch, and the second switch is configured to be turned on or off according to the second control instruction;

a first end of the second switch serves as an input of the second pull-up circuit, and a second end of the second switch serves as an output of the second pull-up circuit.

8. The driving circuit of the display panel according to claim 7, wherein the second switch is an electronic switching transistor, a control end of the electronic switching transistor serves as the first end of the second switch, and a current output of the electronic switching transistor serves as the second end of the second switching transistor.

9. The driving circuit of the display panel according to claim 8, wherein the electronic switching transistor is an N-type thin film crystal field effect transistor;

a drain electrode of the N-type thin film crystal field-effect transistor is an input of the electronic switching transistor, a source electrode of the N-type thin-film crystal field effect transistor is an output of the electronic switching transistor, and a grid electrode of the N-type thin-film crystal field effect transistor is a control end of the electronic switching transistor.

10. The driving circuit of the display panel according to claim 8, wherein the electronic switching transistor is any one of a group consisting of a polycrystalline silicon thin film transistor, an amorphous silicon thin film transistor, a zinc oxide-based thin film transistor and an organic thin film transistor.

11. The driving circuit of the display panel according to claim 7, wherein the second control instruction is an instruction of turning off the second switch; at this moment, the second switch is turned on, the second-array-substrate-row driving circuit receives the second enabling control signal; when the second enabling control signal is a high level signal, the second-array-substrate-row driving circuit outputs the scanning signal; when the second enabling control signal is a low level signal, the second-array-substrate-row driving circuit stops outputting the scanning signal.

12. The driving circuit for the display panel according to claim 7, wherein turning off the second switch is implemented by welding a resistance between an enabling control signal input of the second-array-substrate-row driving circuit and an enabling control signal output of the level conversion circuit.

13. The driving circuit of the display panel according to claim 1, wherein the display panel comprises N rows of pixels and N scanning lines, a first end of each of the N scanning lines is connected with the first scanning signal end, and a second end of each of the N scanning lines is connected with the second scanning signal end; wherein each row of the pixels are connected with the corresponding scanning line, N is greater than or equal to 1, and N is a positive integer;

the N scanning lines are configured to receive the N-level scanning signals, wherein the X-level scanning signal is configured to drive the X-th row of pixels on the display panel, N is greater than or equal to X, X is greater than or equal to 1, and X is a positive integer.

14. The driving circuit for the display panel according to claim 1, wherein when the first enabling control signal is a high level signal, at this time, the first-array-substrate-row driving circuit outputs a scanning signal, when the first enabling control signal is a low level signal, at this time, the first-array-substrate-row driving circuit stops outputting the scanning signal.

15. A display device, comprising:

a display panel, wherein a first lateral side of the display panel is provided with a first scanning signal end, and a second lateral side of the display panel is provided with a second scanning signal end; and a control circuit, wherein the control circuit comprises:

a scanning-signal-control circuit configured to output a first enabling control signal, a second enabling control signal and a scanning signal according to a control instruction as input by a user, wherein the control instruction comprises a first control instruction and a second control instruction;

a first-array-substrate-row driving circuit configured to output the scanning signal to the first scanning signal end under control of the first enabling signal; and a second-array-substrate-row driving circuit configured to output the scanning signal to the second scanning signal end under control of the second enabling control signal;

wherein the scanning-signal-control circuit comprises;

a screen driving board configured to receive a video signal and output a start control logic signal, a scanning clock logic signal, a low frequency logic signal and an enabling control logic signal according to the video signal;

a level conversion circuit configured to receive the start control logic signal, the scanning clock logic signal, the low frequency logic signal and the enabling control logic signal, and to output an enabling control signal according to the enabling control logic signal, to output a first low frequency clock signal and a second low frequency clock signal according to the low frequency logic signal, and to output the scanning signal according to the scanning clock logic signal; wherein the scanning signal comprise N-level scanning signals, and wherein N is greater than or equal to 1, and N is a positive integer;

wherein the screen driving board is provided with a GIPO (General Purpose Input and Output) which is configured to output an enabling control logic signal to the level conversion circuit, the level conversion circuit is provided with a low frequency signal port configured to convert the enabling control logic signal into an enabling control signal, this enabling control signal includes a high level signal and a low level signal;

a power management circuit configured to provide power supply to the scree driving board and the level conversion circuit respectively, wherein the power management circuit is respectively connected with the screen driving board and the level conversion circuit;

a first pull-up circuit configured to receive the enabling control signal and output a first enabling control signal according to the first control instruction and the enabling control signal; wherein an input of the first pull-up circuit is connected with an enabling control signal output of the level conversion circuit, and an output of the first pull-up circuit is connected with a first enabling control signal input of the display panel; and a second pull-up circuit configured to receive the enabling control signal and output a second enabling control signal according to the second control instruction and the enabling control signal; wherein an input of the second pull-up circuit is connected with an enabling control signal output of the level conversion circuit, and an output of the second pull-up circuit is connected with a second enabling control signal input of the display panel.

16. The display device according to claim 15, wherein the first pull-up circuit is a first switch, and the first switch is configured to be turned on or off according to the first control instruction;

a first end of the first switch serves as the input of the first pull-up circuit, and a second end of the first switch serves as the output of the first pull-up circuit.

* * * * *